United States Patent [19]

Scott et al.

[11] Patent Number: 4,882,041

[45] Date of Patent: Nov. 21, 1989

[54] DILUENT SUBSTITUTION PROCESS

[75] Inventors: Jeffery E. Scott; David W. McDougall; Ronald G. Holcek, all of Calgary, Canada

[73] Assignee: Delta Projects Inc., Calgary, Canada

[21] Appl. No.: 59,697

[22] Filed: Jun. 9, 1987

[30] Foreign Application Priority Data

Mar. 6, 1986 [CA] Canada ..... 503434

[51] Int. Cl.[4] ..... C10G 31/06

[52] U.S. Cl. ..... 208/177; 208/14; 208/348; 208/349; 208/180

[58] Field of Search ..... 208/177, 178, 180, 181, 208/184, 186, 251 R, 14, 15, 348, 349

[56] References Cited

U.S. PATENT DOCUMENTS

| | | | |
|---|---|---|---|
| 2,315,935 | 8/1940 | Child | 208/15 X |
| 2,508,967 | 9/1951 | Offutt et al. | 208/15 X |
| 2,789,083 | 4/1957 | Hardy | 208/177 |
| 2,793,108 | 5/1957 | Corneil et al. | 208/251 R |
| 3,767,504 | 10/1973 | Youngblood et al. | 208/15 X |
| 4,040,958 | 8/1977 | Rammler | 208/177 X |
| 4,127,393 | 11/1978 | Timmins et al. | 208/356 X |
| 4,162,965 | 7/1979 | Clapper | 208/177 |
| 4,191,640 | 3/1980 | Chess et al. | 208/348 |
| 4,396,498 | 8/1983 | Dente et al. | 208/177 X |
| 4,661,242 | 4/1987 | Scott et al. | 208/177 |
| 4,722,781 | 2/1988 | Swartz et al. | 208/177 X |

OTHER PUBLICATIONS

"Re-Refining Uses Propane Treat", Hydrocarbon Processing, Apr. 1974, pp. 129–131.

Gurel, D. O., "Operating Practices to Improve the Profitability of Conventional Heavy Crude Production", in The Future of Heavy Crude and Tar Sands, UNITAR, 1981, p. 791.

Gorrill, R. G.; Kitzan, P.; Komery, D. P.; "The Design of the Peace River in situ Oil Sands Pilot Project", in The Future of Heavy Crude and Tar Sands, UNITAR 1981, p. 378.

Capeling. R. R., "In Situ Development at Marguerite Lake", Energy Processing—Canada, Aug.–Oct., 1985, p. 24.

"Increase Crude Demand Prompts IPL Expansion Program", Oilweek, Nov. 19, 1984, p. 9.

"Higher Prices, Rising Exports Spark Canada's Heavy Oil Areas", Oil and Gas Journal, Oct. 18, 1984, p. 62.

*Primary Examiner*—Glenn Caldarola

*Attorney, Agent, or Firm*—Rogers, Bereskin & Parr

[57] ABSTRACT

In a process for the treatment of heavy oil, in which a hydrocarbon diluent is added to the heavy oil stream, part of the diluent is substituted by an LPG liquid stream. The LPG stream is added to the heavy oil stream after removal of light components including methane and carbon dioxide to reduce the vapor pressure of the stream, producing a sales oil stream.

7 Claims, 1 Drawing Sheet

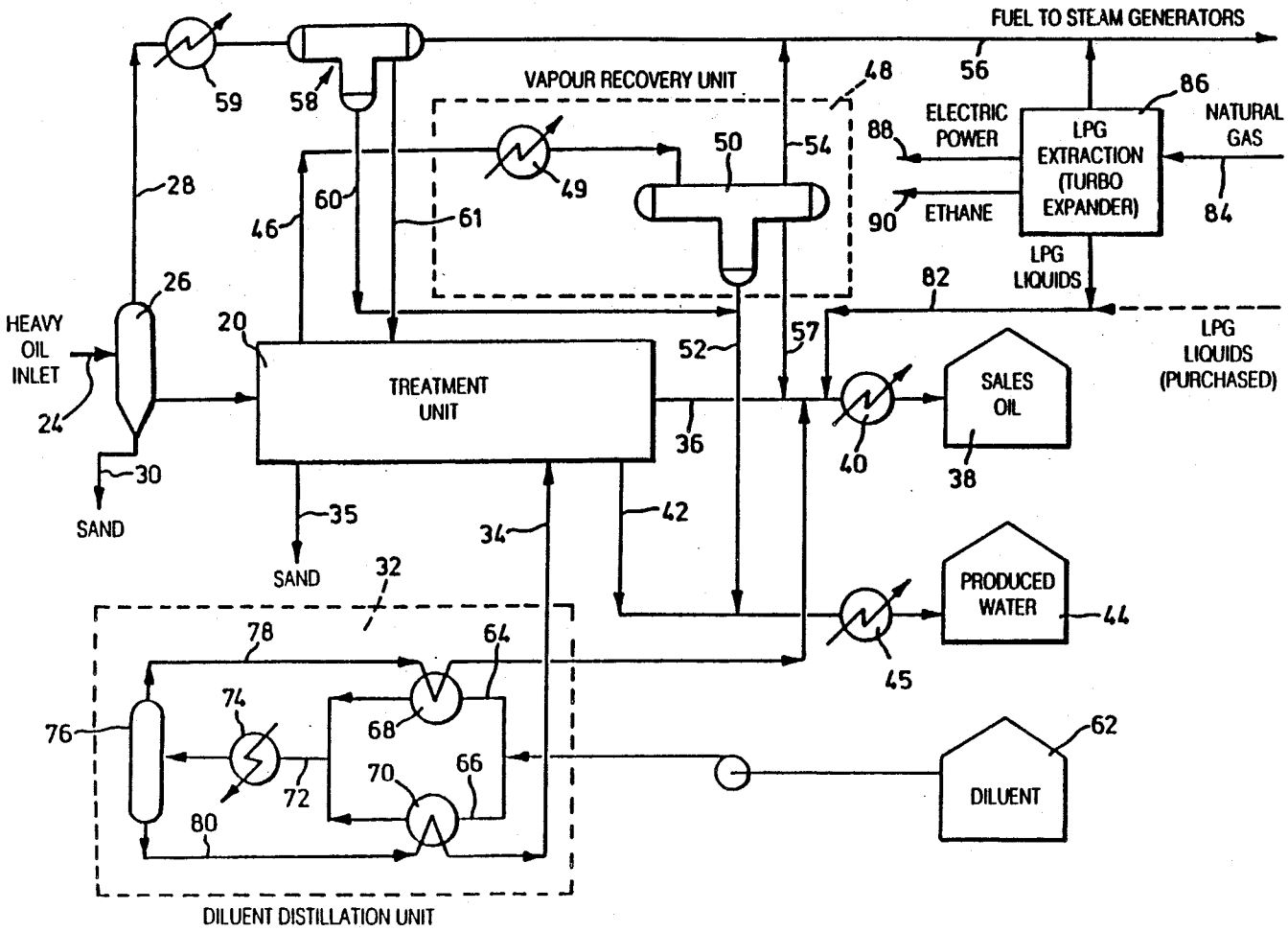
FUEL TO STEAM GENERATORS
NATURAL GAS
LPG EXTRACTION (TURBO EXPANDER)
LPG LIQUIDS (PURCHASED)
LPG LIQUIDS
ELECTRIC POWER
ETHANE
SALES OIL
PRODUCED WATER
DILUENT
VAPOUR RECOVERY UNIT
TREATMENT UNIT
SAND
SAND
HEAVY OIL INLET
DILUENT DISTILLATION UNIT
56
86
84
88
90
82
38
40
44
45
62
48
54
57
50
52
36
42
49
61
34
64
66
68
70
32
58
60
46
35
72
78
74
80
59
28
26
20
30
24
76

DILUENT SUBSTITUTION PROCESS

FIELD OF THE INVENTION

This invention relates generally to the treatment of production fluids containing heavy oil and bitumen.

BACKGROUND OF THE INVENTION

Certain heavy liquid hydrocarbon streams are produced from natural deposits of bitumen in sand or from natural deposits of heavy conventional oil referred to as "heavy oil" or sometimes as "extra heavy oil". These streams are called "production fluids"; the hydrocarbon portion of the stream may be bitumen or heavy oil but, for convenience the term "heavy oil" will be used hereafter to include both such portions. Heavy oil production streams are viscous and do not flow readily except at elevated temperatures. Streams containing these materials also contain volatiles (e.g. natural gas), water and sand, all of which must be separated from the heavy oil.

DESCRIPTION OF THE PRIOR ART

In a typical conventional treatment process, free gas or vapour is first liberated from the production stream in a degassing vessel. Some sand may also be removed at this time. The remaining fluid is injected into a treatment unit including heat exchangers and separation equipment. Here, the balance of the sand is removed and the heavy oil is separated from the remaining liquid components of the stream and from any additional volatiles produced in the treatment unit. The treated oil (often called "sales oil") can then be delivered to storage or other processing equipment.

The mechanisms of separation in the treatment unit depend strongly on the density and viscosity of the heavy oil, and separation is facilitated when the values of these properties are lowered. This is normally done by adjusting the operating temperature and by blending in lighter hydrocarbon streams referred to as diluent streams. Diluent addition also determines the viscosity of the sales oil output stream.

A diluent can be any miscible stream that is lighter than the heavy oil, but it must be relatively involatile or it will not stay in solution. A typical diluent is stabilized condensate (also referred to as pentanes plus or natural gasoline) and is produced in natural gas processing facilities. Other diluents could be light refinery streams such as naphtha.

SUMMARY OF THE INVENTION

An object of the present invention is to provide a process for the treatment of a heavy oil production stream, in which the amount of diluent that is required is reduced compared with an equivalent conventional process.

The process provided by the invention involves initially removing sand and water from the heavy oil production stream and adding a first diluent to the stream to reduce the density and viscosity of the heavy oil. The heavy oil is then treated to remove light components including methane and carbon dioxide and reduce the vapour pressure of the stream. After removal of the light components, a liquified petroleum gas (LPG) diluent stream is injected into the heavy oil production stream to lower the viscosity of this stream and form a sales oil stream.

Injection of the LPG diluent stream allows a reduction in the amount of the first diluent (often called "heavy diluent"). LPG diluent addition can also lower the viscosity of the oil to a greater degree than can addition of an equivalent amount of heavy diluent, resulting in a further reduction in the use of the heavy diluent. In other words, LPG diluent is in effect substituted for part of the heavy diluent stream. Since LPG diluent is less expensive than heavy diluent, this reduces the overall treatment cost of the heavy oil.

The term "LPG" (liquified petroleum gas) as used in this application refers to gas comprising mainly propane, butanes, and some pentanes, possibly together with heavier components. These are generally referred to as "LPG liquids". LPG liquids could be propane only, butane only or any combination of propane, butanes and pentanes possibly together with other heavier components. One source for an LPG diluent stream would be LPG liquids extracted from a fuel gas stream such as a natural gas stream. The term "fuel gas stream" as used herein means any gas stream having value as a fuel. LPG liquids for forming a diluent stream could also be purchased from outside sources.

The first diluent added to the heavy oil production stream to reduce the density and viscosity of the heavy oil will be of the form described previously.

The invention also provides a corresponding apparatus for performing the process of the invention. The apparatus will include a treatment that may itself be of essentially conventional form and typically will include heat exchangers and separation equipment for removal of volatiles, water and sand from the production stream.

BRIEF DESCRIPTION OF THE DRAWING

In order that the invention may be more clearly understood, reference will now be made to the accompanying drawing which is a diagrammatic illustration of a heavy oil treatment apparatus in accordance with a preferred embodiment of the invention.

DESCRIPTION OF THE PREFERRED EMBODIMENT

The apparatus shown in the drawing includes a heavy oil treatment unit generally denoted by reference numeral 20. An incoming heavy oil production stream is indicated by line 24. The heavy oil is delivered first to a degasser 26 in which free gas or vapour is separated from the production stream; the vapour leaves degasser 26 through a line 28. Some sand may also be removed in the degasser as indicated at 30. In the treatment unit 20, a first diluent stream is added to the heavy oil stream from a diluent distillation unit 32 (to be described). The diluent stream itself is indicated at 34.

Treatment unit 20 includes heat exchangers and separation equipment as are well known in the art. Here, the balance of the sand is removed from the production stream at 35. A treated oil stream leaving the treatment unit is denoted 36 and is ultimately delivered as sales oil to other processing equipment or storage as represented at 38. A cooler in that stream is denoted 40. A water stream leaving the treatment unit is denoted 42 and again flows to storage or other processing equipment indicated at 44 via a cooler 45. A vapour stream leaving the treatment unit is denoted 46. That stream passes to a vapour recovery unit 48. Unit 48 includes a cooler 49 and a phase separator 50. Separator 50 is a three-phase separator which receives the cooled vapour from cooler 49 and separates the vapour into a water stream 52, a vapour stream 54 and a liquid hydrocarbon stream 57. Stream 52 connects to the water stream 42 leaving the treatment unit and stream 57 connects to the treated oil stream 36. The vapour stream 54 connects with a main vapour stream 56. The vapour leaving the system in this stream is used for fuel. Stream 56 also receives vapour from a phase separator 58 in the degasser output line 28. That line also includes a cooler 59. Water removed in separator 58 leaves along a stream denoted 60 which couples with the main water output stream 42. Light hydrocarbons removed in separator 58 are delivered in a stream 61 to the treatment unit 20.

Diluent stream 34 is processed in distillation unit 32 prior to entering the treatment unit 20 to distill out lighter components which would otherwise tend to vapourize in the treatment unit. So-called "heavy diluent" from a supply 62 is pumped into the unit 32 where it is split into two streams 64 and 66. Stream 64 is warmed in a heat exchanger 68 and stream 66 is warmed in a heat exchanger 70. The two warmed streams then recombine to form a stream 72 which is further heated in a heater 74. The stream leaving heater 74 will be a two-phase stream of vapour and liquid and is delivered to a phase separator 76 where the stream is separated into a vapour phase and a liquid phase. The vapour phase (referred to as distillate) leaves the separator as a stream 78 and is cooled and condensed by heat exchange with the incoming stream 64 in heat exchanger 68. The cooled distillate stream 78 is injected into the treated heavy oil production stream 36 leaving the treatment unit 20.

The liquid stream leaving phase separator 76 (referred to as distilled diluent) leaves the- separator as a stream 80 and is cooled in heat exchanger 70 by heat exchange with the incoming diluent stream 66. The cooled liquid stream then flows to the treatment unit 20 as stream 34 where it is blended with the production stream.

A liquid petroleum gas (LPG) diluent stream is also added to the system in a stream denoted 82 immediately upstream of the cooler 40 in the treated oil production stream 36 as will be described. The advantages of this LPG diluent addition is that the LPG diluent stream allows a reduction in the amount of heavy diluent required from supply 62. The LPG diluent stream also lowers the viscosity of the oil in the treated oil output stream 36 to a greater degree than would an equivalent amount of heavy diluent, resulting in a further reduction in the use of diluent. Further, LPG diluent is less expensive than an equivalent amount of heavy diluent. In summary, the use of the LPG diluent stream in place of heavy diluent will reduce the treatment cost of the heavy oil.

Injection of an LPG diluent stream is possible because the vapour pressure of the treated oil is reduced by removal of methane, carbon dioxide and other lighter components from the heavy oil in the treatment unit 20. The vapour stream 46 leaving treatment unit 20 contains predominantly water, vapour, carbon dioxide, methane and components of the distilled diluent stream. That vapour is cooled in the vapour recovery unit 48. Phase separator 50 removes in stream 54, vapour containing predominantly methane and carbon dioxide and these components are used as fuel.

It is advantageous to maximize the addition of LPG diluent, the quantity of which is affected by the method of vapour recovery in unit 48. For example, two or more stages of cooling and separation could be used in the vapour recovery unit 48 instead of the single stage shown. Alternatively, a fractionation tower could be used to remove these lighter components. Other alternatives include a treating system on the vapour stream from the treatment unit for carbon dioxide removal. Another alternative includes the use of a water wash system in the treatment unit for carbon dioxide removal. These processes minimize recombining volatile components with the treated oil thereby reducing the vapour pressure of the treated oil and allowing for the addition of more LPG diluent which in turn reduces the amount of heavy diluent required.

Another alternative for removal of methane, carbon dioxide and other lighter components from the heavy oil inlet stream would be the injection of distilled diluent into the treatment unit in two stages. With this system, two separate vapour streams would leave the treatment unit. Each of these vapour streams would be cooled and separated separately in the vapour recovery unit.

In the illustrated embodiment, a natural gas stream 84 is shown as the source of the LPG diluent stream. LPG liquids are extracted from the natural gas stream by means of a turbo-expander and fractionation facility generally indicated by reference numeral 86. This facility is conventional in itself and has not therefore been described in detail. In a heavy oil facility, a natural gas stream is normally available as a fuel for the high pressure steam generators used in such a facility and accordingly the natural gas stream may be a convenient source of LPG liquids in a practical installation. By-products of the turboexpander and fractionation facility 86 would be electric power as indicated at 88 and/or ethane as indicated at 90.

Extraction of LPG liquids from natural gas has the advantage that the LPG liquids are more valuable in the sales oil stream than they are in the natural gas (or fuel gas) stream.

LPG liquids for use in the diluent stream 82 could alternatively be purchased from outside sources and even then are less expensive than corresponding amounts of heavy diluent.

It should also be noted that the LPG liquids need not be introduced into the treated heavy oil stream in liquid form; they could be introduced in the gaseous phase and subsequently condensed in cooler 40.

It will of course be understood that the preceeding description relates to a particular preferred embodiment of the invention only and that many modifications are possible within the broad scope of the invention. Some of those modifications have been indicated previously and others will be apparent to persons skilled in the art. One such modification may be to omit the diluent distillation unit 32 and deliver diluent directly the treatment unit 20.

Where diluent distillation is employed, different distillation methods are possible. For example, a stripping agent such as steam could assist in the distillation; two or more stages of vapour separation could be employed instead of the single stage described. The second and subsequent separation stages would involve reducing the pressure of the liquid stream from the first stage and separating the stream into a second stage liquid stream and a second stage vapour stream. This would normally require that the incoming diluent be pumped to a higher pressure. Alternatively, the diluent could be distilled in a fractionation tower, which makes possible a multitude of alternatives; for example, a stripping tower without reflux, or the addition of an overhead condenser and refluxing the condensed phase to the tower. The condenser can be an integral part of the fractionation tower, or separate, in which case a reflux accumulator and reflux pumps would be required. The raw diluent would be fed directly to the distillation column without being preheated (the normal heating effect within the column would then cause the required vapourization), or it could be preheated either by heat exchange with distilled diluent or with some other process stream or source of external heat.

Finally, it should be noted that it is not essential to subject the vapour stream leaving the phase separator 76 of the distillation unit to condensation prior to introducing the stream into the treated oil stream. The vapour stream could be injected directly into the oil stream and cooled together with the oil stream. In that event, some condensation will inevitably take place in the line between the distillation unit and the production stream. Even where condensation is employed, the stream may not be wholly condensed.

Similarly, it is not essential that the liquid diluent stream leaving the distillation unit be cooled prior to entering the treatment unit.

The diluent distillation process and apparatus referred to herein is more fully described in co-pending Canadian Patent Application Ser. No. 475,635 filed Mar. 1, 1985.

We claim:

1. A process for the treatment of a heavy oil production stream, comprising the steps of:

removing sand and water from said stream;

adding a hydrocarbon diluent to said stream to reduce the density and viscosity of the heavy oil;

removing from the heavy oil of reduced density and viscosity light components including methane and carbon dioxide and reduce the vapour pressure of the stream; and, injecting into said stream after removal of said light components, a liquidified petroleum gas (LPG) diluent stream to lower the viscosity of the heavy oil production stream and form a sales oil stream.

2. A process as claimed in claim 1, wherein the LPG diluent stream is extracted from a fuel gas stream and injected into the heavy oil production stream in liquid form.

3. A process as claimed in claim 1 in which said first diluent is subjected to distillation prior to its addition to the heavy oil stream to remove at least some of the light components in the diluent that would otherwise vapourize after the diluent had been added to the heavy oil stream.

4. A process as claimed in claim 3, wherein said first diluent is separated into a liquid stream and a vapour stream during said distillation step and wherein the liquid stream is introduced into the heavy oil stream to provide said addition of the first diluent, while the vapour stream is introduced into the treated oil stream downstream of the location at which the heavy oil of reduced density and viscosity is treated to remove light components.

5. A process as claimed in claim 4, wherein said vapour stream is subjected to condensation prior to its introduction into the treated oil stream.

6. A process as claimed in claim 5, wherein said step of subjecting the vapour stream to condensation is performed by bringing the vapour stream into heat exchange relationship with a stream of said first diluent prior to said step of subjecting the diluent to distillation.

7. In a process for the treatment of a heavy oil production stream, in which a hydrocarbon diluent is added to the heavy oil production stream to form a stream of reduced density and viscosity;

the improvement comprising substituting for a portion of said hydrocarbon diluent a liquified petroleum gas (LPG) diluent stream by first removing, from said stream of reduced density and viscosity, light components including methane and carbon dioxide to reduce the vapour pressure thereof and permit subsequent injection into the stream of reduced density and viscosity of said LPG diluent stream, and after removal of said light components injecting said LPG diluent stream into said stream of reduced density and viscosity to lower the viscosity thereof and form a sales oil stream.

* * * * *